US007881625B2

(12) United States Patent
Kinouchi et al.

(10) Patent No.: US 7,881,625 B2
(45) Date of Patent: Feb. 1, 2011

(54) FIXING DEVICE WITH NON-CONTACT TEMPERATURE SENSOR AND CONTACT TEMPERATURE SENSOR

(75) Inventors: Satoshi Kinouchi, Shinjuku-ku (JP); Osamu Takagi, Chofu (JP); Yoshinori Tsueda, Fuji (JP); Toshihiro Sone, Yokohama (JP)

(73) Assignees: Kabushiki Kaisha Toshiba, Tokyo (JP); Toshiba Tec Kabushiki Toshiba, Tokyo (JP)

( * ) Notice: Subject to any disclaimer, the term of this patent is extended or adjusted under 35 U.S.C. 154(b) by 755 days.

(21) Appl. No.: 11/695,269

(22) Filed: Apr. 2, 2007

(65) Prior Publication Data

US 2008/0240748 A1 Oct. 2, 2008

(51) Int. Cl.
*G03G 15/20* (2006.01)

(52) U.S. Cl. ..... 399/33; 399/69; 399/122

(58) Field of Classification Search ..... 399/33, 399/44

See application file for complete search history.

(56) References Cited

U.S. PATENT DOCUMENTS

| | | | | |
|---|---|---|---|---|
| 6,626,835 | B1 * | 9/2003 | Kraus | 600/454 |
| 2006/0062586 | A1 * | 3/2006 | Sone et al. | 399/69 |
| 2006/0204265 | A1 * | 9/2006 | Yoshikawa | 399/69 |

FOREIGN PATENT DOCUMENTS

| | | |
|---|---|---|
| JP | 2000-259033 | 9/2000 |
| JP | 2000-259034 | 9/2000 |
| JP | 2005-024436 | 1/2005 |

* cited by examiner

*Primary Examiner*—David M Gray
*Assistant Examiner*—Roy Yi
(74) *Attorney, Agent, or Firm*—Turocy & Watson, LLP

(57) ABSTRACT

A fixing device of the invention detects a temperature of plural positions of a heat roller by a multiple non-contact temperature sensor at the same time and controls the temperature of plural heat source members. The non-contact temperature sensor and a contact temperature sensor detect the temperature of the same position. According to the detection result, maintenance is performed or a temperature conversion table is corrected, the non-contact temperature sensor is maintained with high precision, and the heat roller is controlled the temperature with high precision.

5 Claims, 10 Drawing Sheets

FIXING DEVICE WITH NON-CONTACT TEMPERATURE SENSOR AND CONTACT TEMPERATURE SENSOR

FIELD OF THE INVENTION

The present invention relates to a fixing device which is mounted in an image forming apparatus, such as a copier, a printer or a facsimile, and heats and fixes a toner image on a sheet paper.

BACKGROUND OF THE INVENTION

As a fixing device used for an image forming apparatus such as an electrophotographic copier or printer, there is a fixing device in which a sheet paper is inserted into a nip formed between a pair of rollers including a heat roller and a pressure roller, or between similar fixing belts, and a toner image is heated, pressurized and fixed. In the thermal fixing device as stated above, in order to keep the heat roller or the fixing belt at a constant fixable temperature, the surface temperature of the heat roller or the fixing belt is detected by a temperature sensor, and a heat source is ON/OFF controlled according to the detection result.

As the temperature sensor, in recent years, like an infrared temperature sensor, there is used a non-contact temperature sensor to perform temperature detection without contact with a heating target member, such as a heat roller or a fixing belt. Especially, a thermopile infrared temperature sensor has a structure in which the heat capacity of a hot junction part of a thin film thermocouple is made small, and the temperature response is high. As a result, it becomes possible to quickly perform the temperature control of the heating target member with high precision. As the thermopile infrared temperature sensor, there are a monocular infrared temperature sensor to detect reflected infrared rays from one place, and a multiple infrared temperature sensor to detect reflected infrared rays from plural positions at the same time.

However, the non-contact temperature sensor as stated above detects also the temperature of a contamination on a surface of an object for which the temperature detection is performed, and a contamination on the surface of the non-contact temperature sensor. Thus, there is a fear that the accurate surface temperature of the object can not be obtained, and erroneous detection occurs. Further, there is a fear that dust or dirt, such as scattered toner or paper powder, is attached to the surface of the heating target member in the fixing device or the non-contact temperature sensor. Further, while the fixing operation is performed, the detection precision of the non-contact temperature sensor is reduced, and there is a fear that an error occurs in the detection result.

Thus, in the non-contact temperature sensor, as a device to prevent the occurrence of temperature error due to the environmental change or contamination, for example, JP-A-2005-24436, JP-A-2000-259034 and JP-A-2005-259033 disclose devices to correct temperature error of a non-contact temperature sensor using a detection result of a contact temperature sensor. In these devices, at the time of a correction operation, the non-contact temperature sensor is mechanically rotated so as to detect the temperature of the same position as the detection position of the contact temperature sensor.

However, any of these non-contact temperature sensors of the related art are monocular infrared temperature sensors, and one place of the fixing device is temperature-detected. On the other hand, in order to temperature-control the fixing device with higher precision, it is preferable to perform the temperature detection of plural positions of the fixing device. However, in the non-contact temperature sensor of the related art, in order to detect temperatures of plural positions of the fixing device, while the fixing is performed, the non-contact temperature sensor must be rotated at high speed, and it is not suitable for practical application.

Then, in a fixing device to detect the surface temperature of a heating target member by using a non-contact temperature sensor, it is desired to develop a fixing device in which temperatures of plural positions of the heating target member are detected in a non-contact manner without rotating the non-contact temperature sensor, the contamination of the surface of an object or the non-contact temperature sensor, and reduction in the detection precision of the non-contact temperature sensor are quickly dealt with, temperature detection of the heating target member is performed in a short time and with high precision, fixing properties are improved, and high picture quality is obtained.

SUMMARY OF THE INVENTION

An aspect of the invention is to detect, by a non-contact temperature sensor, temperatures of plural positions of a heating target member in a short time and with high precision without temperature error due to environmental change or contamination, to improve fixing properties, and to obtain high picture quality.

According to an embodiment of the invention, a fixing device includes a heating target member that comes in contact with a fixing target medium and fixes a toner image on the fixing target medium, a heat source member to heat the heating target member, a non-contact temperature sensor member to detect temperatures of a plurality of positions of the heating target member, and a contact temperature sensor member that comes in contact with a same phase position as at least one of the plurality of positions of the heating target member and detects a temperature of the heating target member.

DETAILED DESCRIPTION OF THE INVENTION

Figure 1:
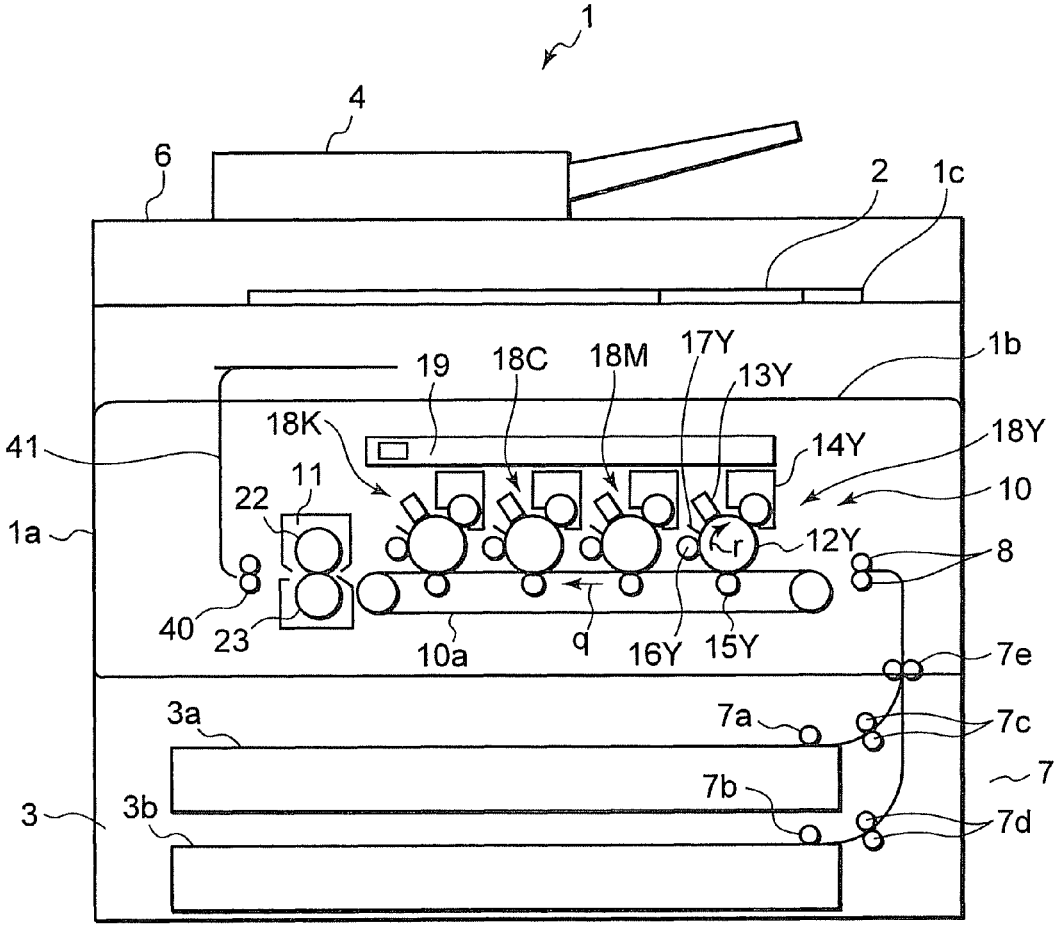
FIG. 1 is a schematic structural view showing an image forming apparatus of a first embodiment of the invention.

Hereinafter, a first embodiment of the invention will be described in detail with reference to the accompanying drawings. FIG. 1 is a schematic structural view showing an image forming apparatus 1 of an embodiment of the invention. A scanner unit 6 to read an original document fed by an automatic document feeder 4 is provided at an upper part of the image forming apparatus 1. Further, a control panel 1*c* having a display panel 2 as a display member is provided on an upper surface of the image forming apparatus 1. The image forming apparatus 1 includes a cassette mechanism 3 to supply a sheet paper P as a fixing target medium, to an image formation unit 10.

The cassette mechanism 3 includes a first and a second paper feed cassettes 3*a* and 3*b*. Pickup rollers 7*a* and 7*b* to pick up sheet papers from the paper feed cassettes 3*a* and 3*b*, separation conveying rollers 7*c* and 7*d*, a conveying roller 7*e* and a register roller 8 are provided on a conveyance path 7 extending from the paper feed cassettes 3*a* and 3*b* to the image formation unit 10. A fixing device 11 to fix a toner image formed on the sheet paper P by the image formation unit 10 is provided downstream the image formation unit 10. A paper discharge roller 40 is provided downstream the fixing device 11, and a paper discharge conveying path 41 to convey the sheet paper P after fixing to a paper discharge unit 1*b* is provided.

The image formation unit 10 includes image formation stations 18Y, 18M, 18C and 18K of respective colors of yellow (Y), magenta (M), cyan (C) and black (K). The image formation stations 18Y, 18M, 18C and 18K are arranged in tandem along a transfer belt 10*a* rotated in an arrow q direction.

The image formation station 18Y of yellow (Y) is constructed such that a charging unit 13Y, a development device 14Y, a transfer roller 15Y, a cleaner 16Y, and a charge-removal unit 17Y which they are a process member are disposed around a photoconductive drum 12Y as an image bearing body rotating in an arrow r direction. A laser exposure device 19 to irradiate a laser beam to the photoconductive drum 12Y is provided over the image formation station 18Y of yellow (Y).

The image formation stations 18M, 18C and 18K of the respective colors of magenta (M), cyan (C) and black (K) have the same structure as the image formation station 18Y.

In the image formation station 18Y of yellow (Y), the photoconductive drum 12Y and its surrounding components of the charging unit 13Y, the development device 14Y, the cleaner 16Y, and the charge-removal unit 17Y constitute a process cartridge, and are integrally detachable from and attachable to a main body 1*a*. The structure of the process cartridge is not limited, and at least one of the charging unit, the development unit and the cleaner and the photoconductive drum are integrally supported, and have only to be detachable from and attachable to the image forming apparatus main body. For example, only the development unit and the cleaner around the photoconductive drum may be integrated into the process cartridge, and may be made to be integrally detachable from and attachable to the image forming apparatus main body, and it is arbitrary.

In the image formation unit 10, when a print operation is started, in the image formation station 18Y of yellow (Y), the photoconductive drum 12Y is rotated in the arrow r direction, and is uniformly charged by the charging unit 13Y. Next, the laser exposure device 19 irradiates the photoconductive drum 12Y with an exposure light corresponding to image information read by the scanner unit 6, and an electrostatic latent image is formed. Thereafter, a toner image is formed on the photoconductive drum 12Y by the development device 14Y, and the toner image is transferred at the position of the transfer roller 15Y to the sheet paper P conveyed in the arrow q direction on the transfer belt 10*a*. After the transfer is finished, a residual toner on the photoconductive drum 12Y is cleaned by the cleaner 16Y, the surface of the photoconductive drum 12Y is diselectrified by the charge-removal unit 17Y, and next printing becomes possible.

In the image formation stations 18M, 18C and 18K of the respective colors of magenta (M), cyan (C) and black (K), image formation operations are performed similarly to the yellow (Y) image formation station 18Y, and a full-color toner image is formed on the sheet paper P. Thereafter, the sheet paper P is heated, pressurized and fixed by the fixing device 11, the print image is completed, and the paper is discharged to the paper discharge unit 1*b*.

Figure 2:
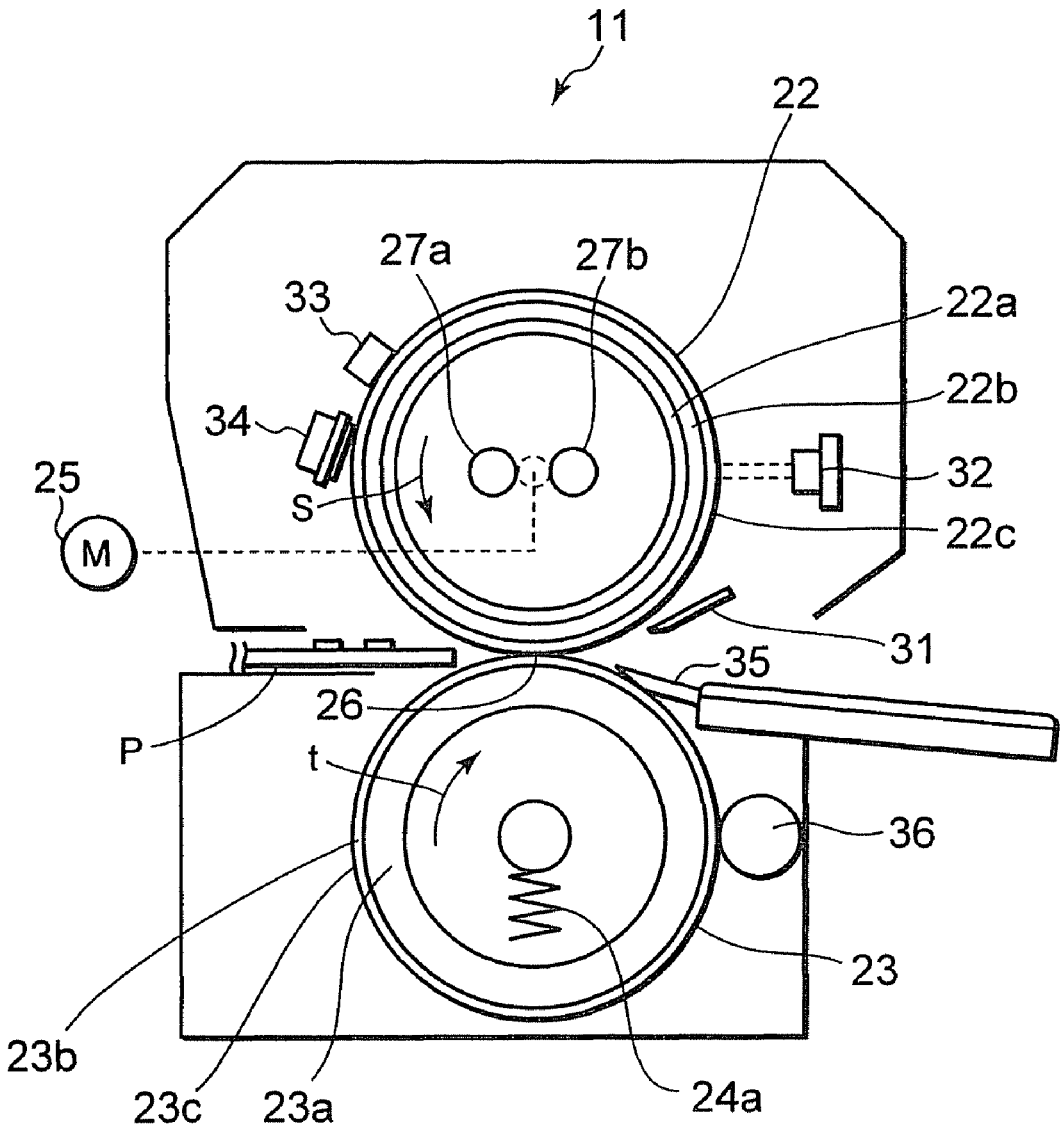
FIG. 2 is a schematic structural view showing a fixing device of the first embodiment of the invention.

Next, the fixing device 11 will be described. FIG. 2 is a schematic structural view showing the fixing device 11. The fixing device 11 is a heating target member, and includes a pair of fixing rollers 20 including a heat roller 22 and a press roller 23. The heat roller 22 is driven in an arrow s direction by a drive motor 25. The press roller 23 is brought into press contact with the heat roller 22 by a pressurizing mechanism including a compression spring 24*a*. By this, a nip 26 with a definite width is formed between the heat roller 22 and the press roller 23. The press roller 23 is rotated in an arrow t direction in accordance with the heat roller 22.

Figure 3:
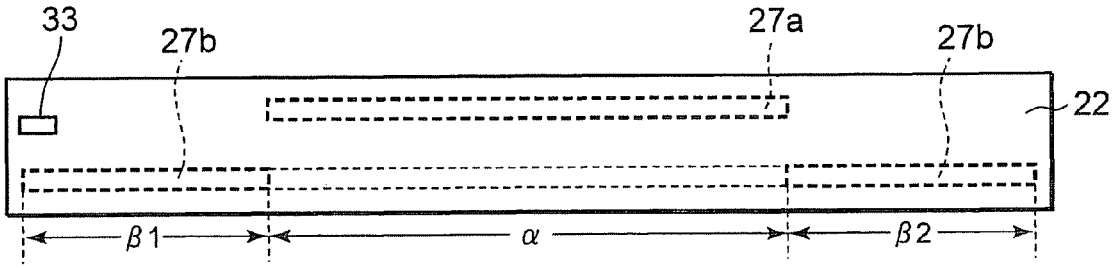
FIG. 3 is a schematic explanation view showing a heat roller of the first embodiment of the invention.

The heat roller 22 includes an aluminum cored bar 22*a* with a thickness of 2 mm, a solid rubber layer 22*b* with a thickness of 1.5 mm therearound, and a release layer 22*c* with a thickness of 30 μm. As shown in FIG. 3, the heat roller 22 includes, as a heat source member, a first halogen lamp heater 27*a* and a second halogen lamp heater 27*b* in the cored bar 22*a*. The first halogen lamp heater 27*a* has a light distribution characteristic to heat an [α] area of the center part of the heat roller 22. The second halogen lamp heater 27*b* has a light distribution characteristic to heat a [β1] area and a [β2] area which extend from both ends of the first halogen lamp heater 27*a* to both ends of the heat roller 22. The first and the second halogen lamp heaters 27*a* and 27*b* are respectively ON/OFF controlled, so that the temperature of the heat roller 22 is uniformly kept in the longitudinal direction over the whole length irrespective of the size of the sheet paper P being conveyed.

The press roller 23 includes a cored bar 23*a* with a thickness of 2 mm, a solid silicon rubber layer 23*b* with a thickness of 1 mm, and a release layer 23*c* with a thickness of 30 μm. Each of the heat roller 22 and the press roller 23 has ϕ40. The sheet paper P passes through the nip 26 between the heat roller 22 and the press roller 23, so that the toner image on the sheet paper P is heated, pressurized and fixed.

A peel pawl 31 to prevent the sheet paper P from winding after the fixing, a thermopile multiple infrared temperature sensor 32 as a non-contact temperature sensor member to detect the surface temperature of the heat roller 22, a thermistor 33 which is a contact temperature sensor member coming in contact with a non-image formation area of the heat roller 22, and a thermostat 34 which detects abnormality of surface temperature of the heat roller 22 and cuts off heating are provided around the heat roller 22. The peel pawl 31 may be either a contact type or a non-contact type. A peel pawl 35 to prevent the sheet paper P from winding after the fixing and a cleaning roller 36 are provided around the press roller 23.

Figure 4:
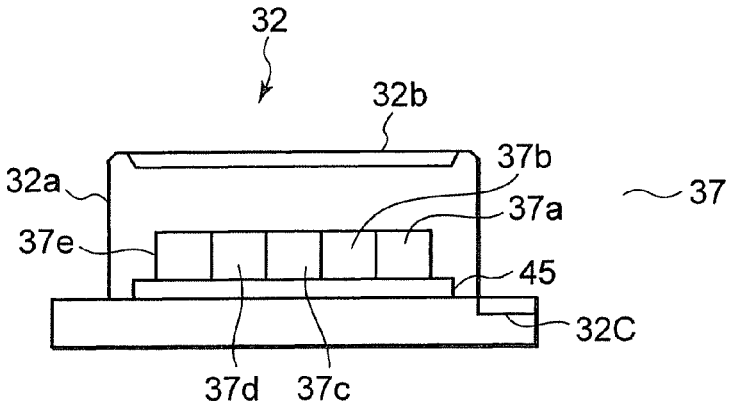
FIG. 4 is a schematic structural view of a multiple infrared temperature sensor of the first embodiment of the invention.

For example, as shown in FIG. 4, the multiple infrared temperature sensor 32 includes, in a housing 32*a*, a first to a fifth detection elements 37*a* to 37*e* including a thermopile in which many thin film thermocouples made of polysilicon and aluminum are connected in series on a silicon substrate 45. In the housing 32*a*, the first to the fifth detection elements 37*a* to 37*e* are arranged linearly in parallel to the longitudinal direction of the heat roller 22. The housing 32*a* includes a silicon lens 32*b*, and condenses infrared rays from the heat roller 22 to the first to the fifth detection elements 37*a* to 37*e*. The infrared rays are received, and the temperature change of hot junction parts generated in the first to the fifth detection elements 37*a* to 37*e* is detected as the electromotive force of the thermocouple. Besides, the multiple infrared temperature sensor 32 includes a thermistor 32*c* to detect its own temperature. The temperature of the heat roller 22 is obtained based on signals from the first to the fifth detection elements 37*a* to 37*e* in view of the ambient temperature of the multiple infrared temperature sensor 32 itself detected by the thermistor 32*c*.

Figure 5:
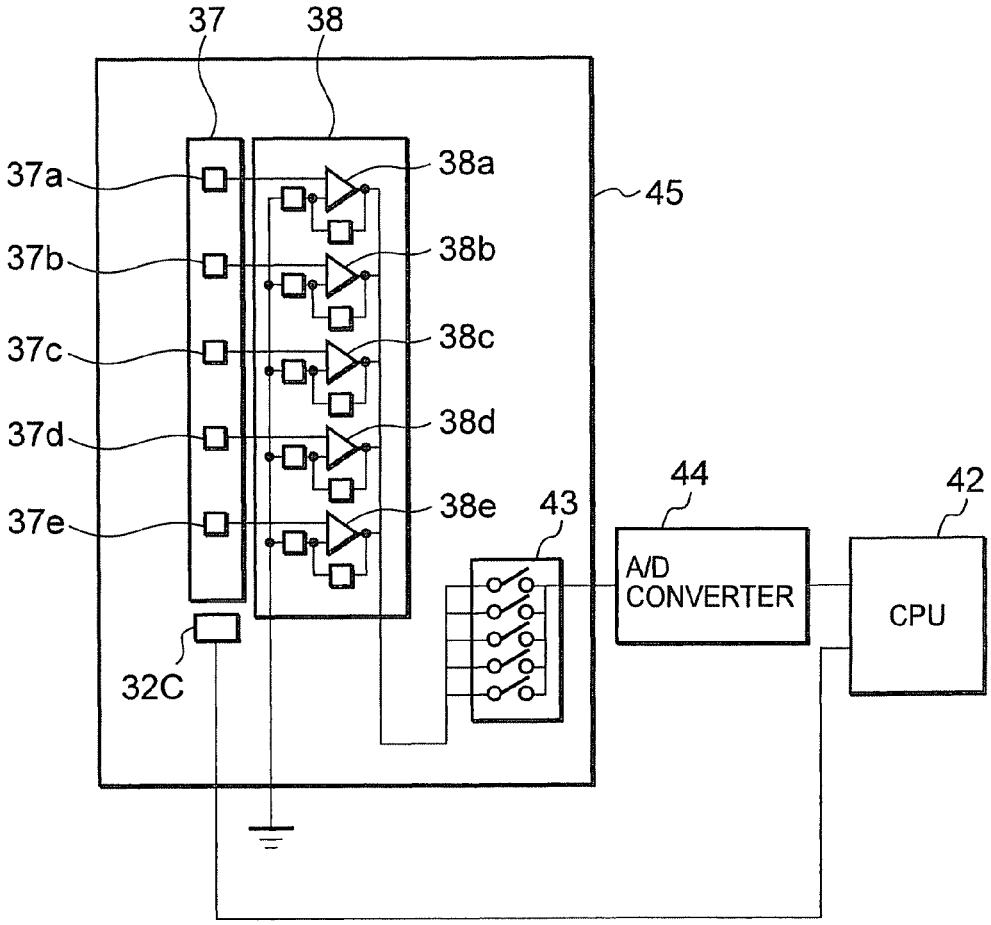
FIG. 5 is a schematic circuit diagram of the multiple infrared temperature sensor of the first embodiment of the invention.

Further, the multiple infrared temperature sensor 32 is constructed such that the housing 32*a* contains the silicon substrate 45 in which as shown in FIG. 5, a thermopile unit 37 including the first to the fifth detection elements 37*a* to 37*e*, an electric circuit 38 including a first to a fifth amplifiers 38*a* to 38*e* to amplify detection outputs of the first to the fifth detection elements 37*a* to 37*e*, and a multiplexer 43 to switch the outputs from the first to the fifth detection elements 37*a* to 37*e* are integrally constructed.

Figure 6:
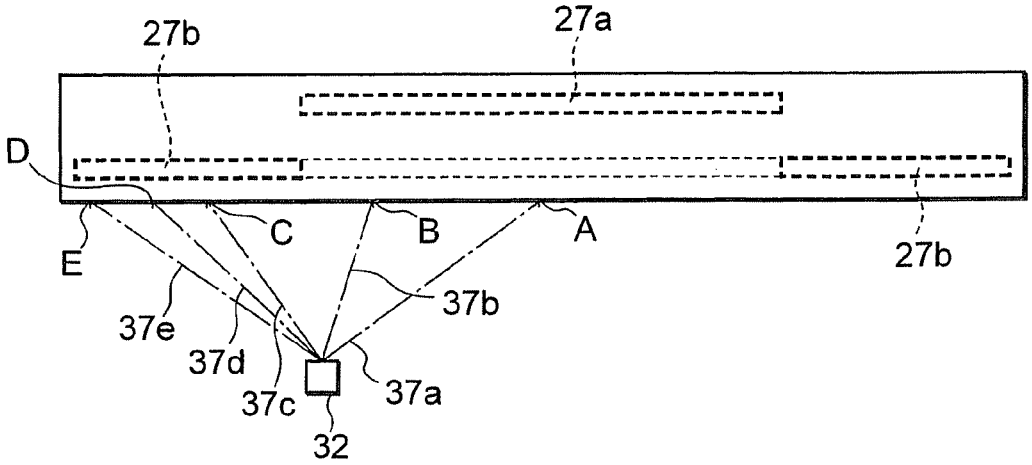
FIG. 6 is a schematic explanatory view showing temperature detection positions on a heat roller by the multiple infrared temperature sensor of the first embodiment of the invention.

The first to the fifth detection elements 37*a* to 37*e* detect plural positions of [A] to [E] on the heat roller 22 shown in FIG. 6. The first detection element 37*a* detects the center [A] of the [α] area of the heat roller 22. The first detection element 37*a* is used for ON/OFF control of the first halogen lamp heater 27*a* to heat the [α] area of the heat controller 22.

The third detection element 37*c* detects the center [C] of the [β1] area of the heat roller 22. The third detection element 37*c* is used for ON/OFF control of the second halogen lamp heater 27*b* to heat the [β1] area and the [β2] area of the heat roller 22. That is, the multiple infrared temperature sensor 32 can detect the plural positions of the heat roller 22 heated by the first halogen lamp heater 27*a* and the second halogen lamp heater 27*b* at the same time.

The fifth detection element 37*e* detects the position [E] of the same phase as the thermistor 33 which comes in contact with the non-image formation area of the heat roller 22. The second detection element 37*b* detects the intermediate position [B] between the position [A] and the position [C] of the heat roller 22. The fourth detection element 37*d* detects the intermediate position [D] between the position [C] and the position [E] of the heat roller 22.

The first to the fifth detection elements 37*a* to 37*e* including the thermopile in the multiple infrared temperature sensor 32 can detect the temperature of an object in a non-contact manner, and the heat capacity of the hot junction part of the thin film thermocouple is small, and therefore, the temperature response is high.

Figure 7:
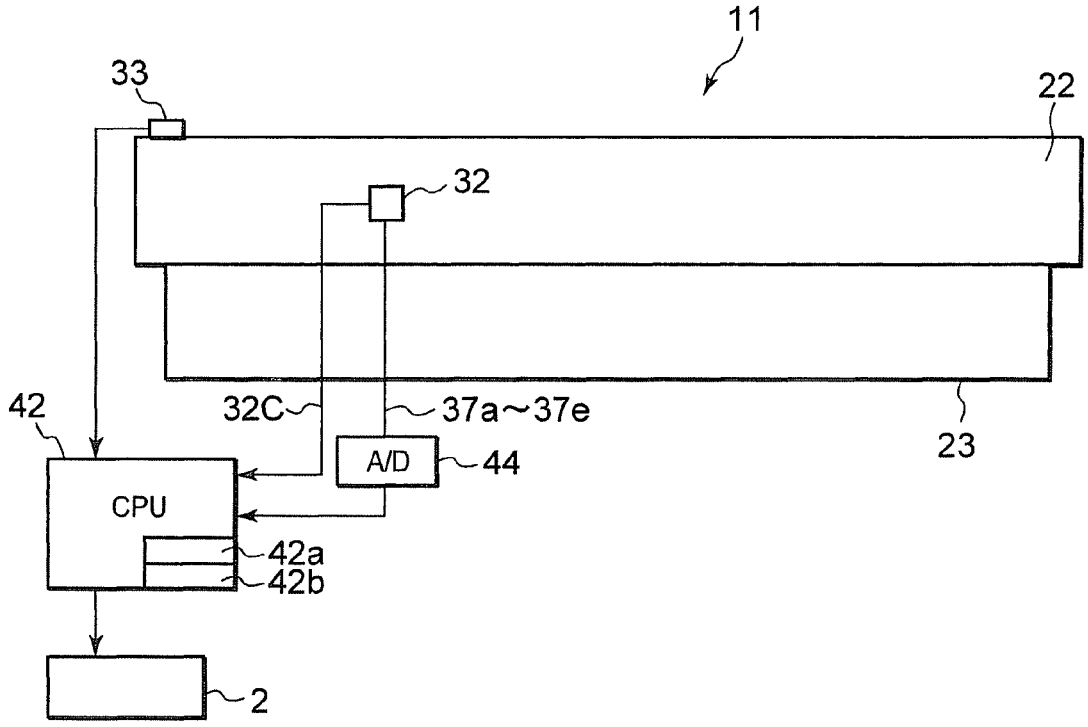
FIG. 7 is a schematic block diagram showing a control system of the multiple infrared temperature sensor of the first embodiment of the invention.

The output of the multiple infrared temperature sensor 32 as the second detection result is converted into a digital signal by an A/D converter 44, and is inputted to a CPU 42 which controls the whole image forming apparatus 1. Further, the output of the thermistor 32*c*, and the output from the thermistor 33 as the first detection result are inputted to the CPU 42. As shown in FIG. 7, the CPU 42 includes a temperature conversion table 42*a* to convert the input signal from the A/D converter 44 and the input signal from the thermistor 33 into temperature data. Besides, the CPU 42 includes a first comparison unit 42*b* to compare the input signal from the A/D converter 44 and the input signal from the thermistor 33 and to output a first comparison result.

The temperature conversion table 42*a* is used also as a correction member to correct the detection result of the multiple infrared temperature sensor 32. For example, only in the case where the temperature difference between the multiple infrared temperature sensor 32 and the thermistor 33 in the first comparison unit 42*b* is within 5° C., and immediately after the finish of the cleaning of the multiple infrared temperature sensor 32, the temperature conversion table 42*a* can be corrected. The temperature conversion table 42*a* is corrected, so that temperature error due to the surface change of the heat roller 22 or the aging of the multiple infrared temperature sensor 32 is corrected.

Next, the operation will be described. When the image formation process is started, in the image formation unit 10, toner images are respectively formed on the photoconductive drums 12Y, 12M, 12C and 12K in the image formation stations 18Y, 18M, 18C and 18K of the respective colors of yellow (Y), magenta (M), cyan (C) and black (K). The toner images on the photoconductive drums 12Y, 12M, 12C and 12K are transferred to the sheet paper P on the transfer belt 10*a* rotated in the arrow q direction by the transfer rollers 15Y, 15M, 15C and 15K, and a full-color toner image is formed on the sheet paper P. Thereafter, the sheet paper P is heated, pressurized and fixed by the fixing device 11 kept at a fixable temperature of 160° C., and a print image is completed.

When the image formation process is started, in the fixing device 11, the heat roller 22 is driven in the arrow s direction by the drive motor 25, and the press roller 23 driven by this is rotated in the arrow t direction. Further, in the fixing device 11, the first and the second halogen lamp heaters 27*a* and 27*b* are turned ON, and warm-up of the heat roller 22 is started. When the multiple infrared temperature sensor 32 and the thermistor 33 detect that the surface temperature of the heat roller 22 reaches 160° C., the warm-up is ended. Thereafter, in order to keep the heat roller 22 in the ready state of 160° C., the CPU 42 ON/OFF controls each of the first and the second halogen lamp heaters 27*a* and 27*b* based on the temperature detection results of the plural positions of the heat roller 22 by the multiple infrared temperature sensor 32.

While the surface temperature of the heat roller 22 is detected as stated above, for example, the surface change of the heat roller 22 or the aging of the multiple infrared temperature sensor 32 occurs. Thus, as compared with the amount of infrared rays reaching the thermopile unit 37 of the multiple infrared temperature sensor 32, the detection temperature output becomes different from the actual temperature of the heat roller 22. Alternatively, while the surface temperature of the heat roller 22 is detected, for example, dust or dirt, such as scattered toner or paper powder, is attached to the surface of the silicon lens 32*b* of the multiple infrared temperature sensor 32 or the heat roller 22. Thus, in the multiple infrared temperature sensor 32, the amount of infrared rays passing through the silicon lens 32*b* and reaching the thermopile unit 37 is decreased, and the detection temperature output becomes lower than the actual temperature of the heat roller 22.

Figure 8:
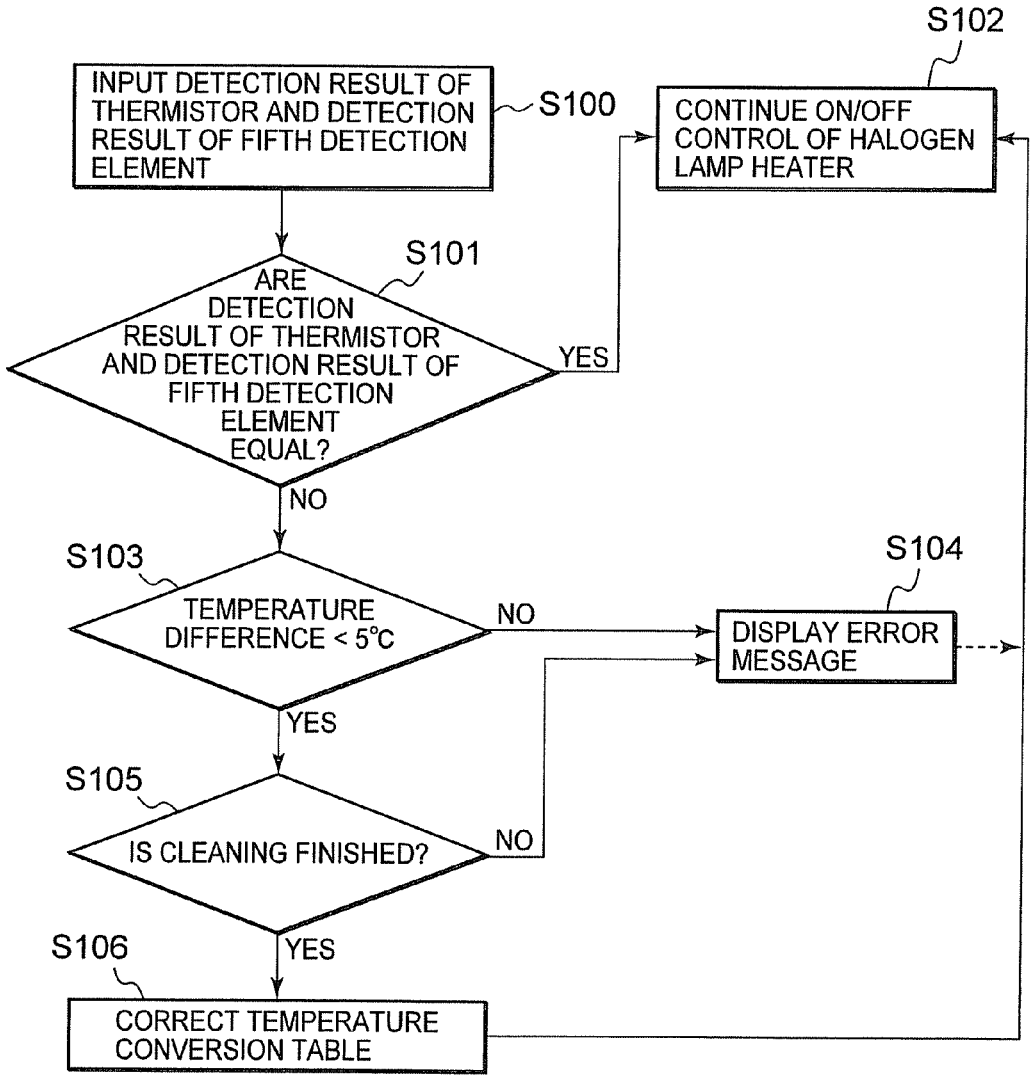
FIG. 8 is a flowchart showing an operation to recognize a state of the multiple infrared temperature sensor of the first embodiment of the invention.

The CPU 42 corrects the detection error occurring in the multiple infrared temperature sensor 32 in accordance with a flowchart shown in FIG. 8 or displays an error message.

That is, while the image formation process is performed, the temperature detection result by the thermistor 33 and the temperature detection result by the fifth detection element 37*e* to detect the temperature of the position [E] of the same phase as the thermistor 33 of the heat roller 22 are inputted to the first comparison unit 42*a* of the CPU 42 (step 100). The first comparison unit 42*b* compares the temperature detection result of the thermistor 33 and the temperature detection result of the fifth detection element 37*e* (step 101).

In the first comparison result of the first comparison unit 42*b*, when the temperature detection results of both are equal to each other (Yes at step 101) the CPU 42 continues the ON/OFF control of the first and the second halogen lamp heaters 27*a* and 27*b* in accordance with the temperature detection result of the multiple infrared temperature sensor 32 (step 102). In the case where the temperature detection results of both are different from each other (No at step 101), it is compared whether the temperature difference between the multiple infrared temperature sensor 32 and the thermistor 33 is less than 5° C. (step 103). When the temperature difference is 5° C. or more, the CPU 42 recognizes that the silicon lens 32*b* is contaminated. The CPU 42 displays the errormessage on the display panel 2 (step 104). Besides, at this time, the image forming apparatus 1 may be stopped at the same time. When doing this, it is possible to prevent the heat roller 22 from being heated to a high temperature by the erroneous detection.

Thereafter, a service man cleans the silicon lens 32*b*. The cleaning of the silicon lens 32*b* may be automatically performed by using a wiper instead of manual cleaning. After the cleaning of the silicon lens 32*b*, the process returns to step 102, and the ON/OFF control of the first and the second halogen lamp heaters 27*a* and 27*b* is continued in accordance with the temperature detection result of the multiple infrared temperature sensor 32.

When the temperature different is less than 5° C. at step 103, it is compared whether the cleaning of the silicon lens 32*b* has been ended (step 105). In the case where the cleaning is not performed, the process proceeds to step 104. When the silicon lens 32*b* has been cleaned at step 105, the CPU 42 recognizes that the response of the multiple infrared temperature sensor 32 is changed by the surface change of the heat roller 22 or the aging of the multiple infrared temperature sensor 32. The CPU 42 corrects the temperature conversion table 42*a* so that the temperature detection results of the multiple infrared temperature sensor 32 and the thermistor 33 after the temperature conversion coincide with each other (step 106) By this, the change of the response of the multiple infrared temperature sensor 32 can be immediately dealt with. Accordingly, the failure of the image forming apparatus 1 is prevented, and the life of the multiple infrared temperature sensor 32 can be made long. Thereafter, the process returns to step 102, and the ON/OFF control of the first and the second halogen lamp heaters 27*a* and 27*b* are continued in accordance with the temperature detection result of the multiple infrared temperature sensor 32.

According to this embodiment, the multiple infrared temperature sensor 32 is used, and accordingly, the temperatures of the plural positions of [A] to [E] on the heat roller 22 can be detected at the same time without mechanically moving the sensor. By this, the first and the second halogen lamp heaters 27*a* and 27*b* can be controlled only by providing the one multiple infrared temperature sensor 32. Besides, the position [E] on the heat roller 22 is detected by the fifth detection element 37*e* and the thermistor 33, so that the error of both sensors can be detected. From the detection result, the state of the multiple infrared temperature sensor 32 is recognized, and the multiple infrared temperature sensor 32 is cleaned, or the temperature conversion table 42*a* is corrected, and the heat roller 22 can be controlled the temperature with high precision, and excellent fixing performance can be obtained.

Next, a second embodiment of the invention will be described. The second embodiment is such that in the first embodiment, the state of the fixing device can also be recognized by the multiple infrared temperature sensor, and the others are the same as the first embodiment. Accordingly, in the second embodiment, the same structures as the first embodiment are denoted by the same symbols and their detailed description will be omitted.

Figure 9:
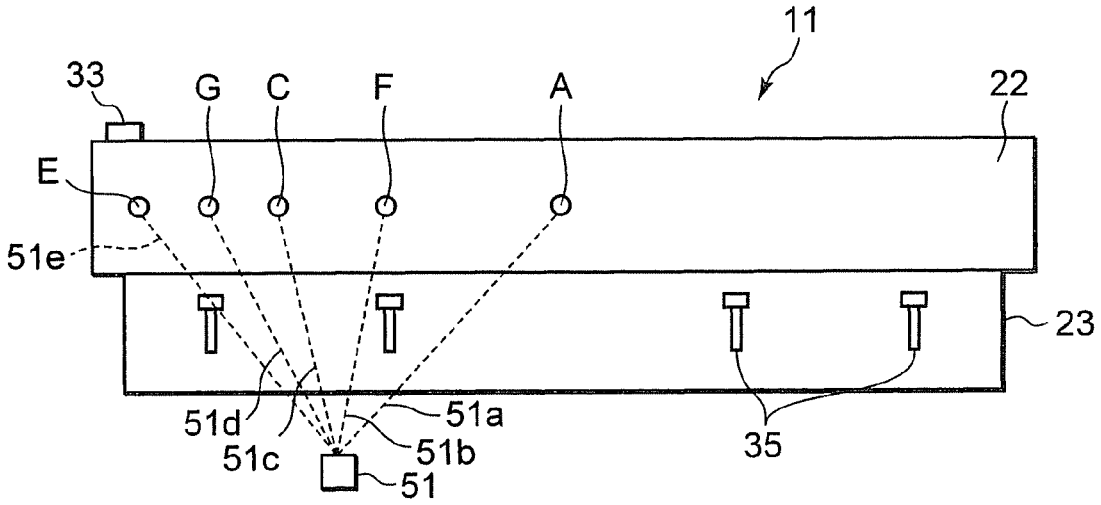
FIG. 9 is a schematic explanatory view showing temperature detection positions on a heat roller by a multiple infrared temperature sensor of a second embodiment of the invention.

A first to a fifth detection elements 51*a* to 51*e* of a multiple infrared temperature sensor 51 of the second embodiment detect plural positions of [A], [C], [E], [F], and [G] on a heat roller 22 shown in FIG. 9. The first detection element 51*a* detects the center [A] of an [α] area of the heat roller 22. The first detection element 51*a* is used for ON/OFF control of a first halogen lamp heater 27*a* to heat the [α] area of the heat roller 22.

The third detection element 51*c* detects the center [C] of a [β1] area of the heat roller 22. The third detection element 51*c* is used for ON/OFF control of a second halogen lamp heater 27*b* to heat the [β1] area or a [β2] area of the heat roller 22. That is, the multiple infrared temperature sensor 32 can detect the plural positions of the heat roller 22 heated by the first halogen lamp heater 27*a* and the second halogen lamp heater 27*b*.

The fifth detection element 51*e* detects the position [E] of the same phase as a thermistor 33 of the heat roller 22. The second detection element 51*b* detects the position [F] which is located between the position [A] and the position [C] of the heat roller 22 and has the same phase as one of peel pawls 35 at the side of a press roller 23. The fourth detection element 51d detects the position [G] which is located between the position [C] and the position [E] of the heat roller 22 and has the same phase as one of the peel pawls 35 at the side of the press roller 23.

Figure 10:
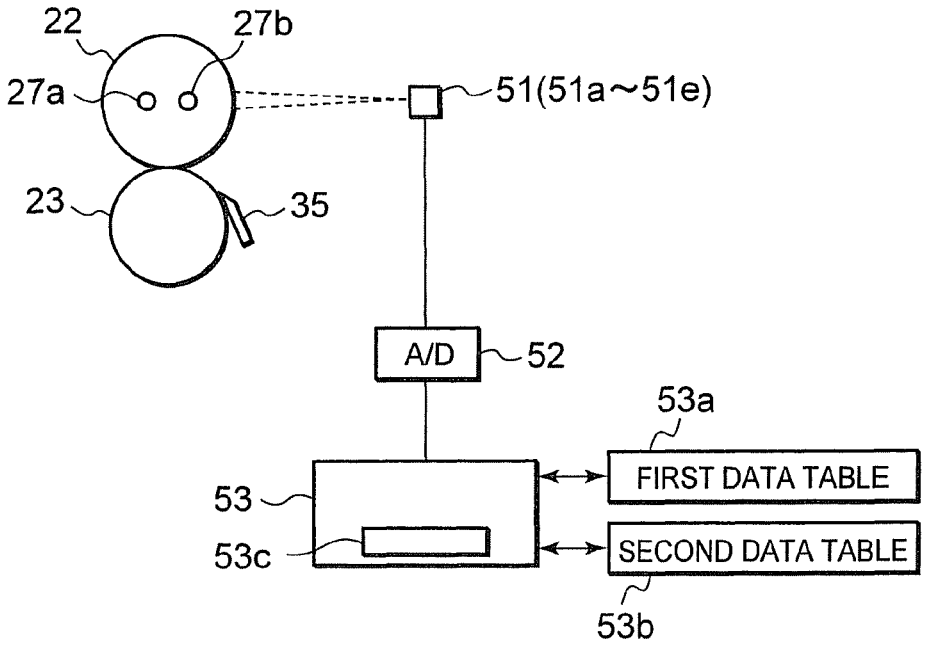
FIG. 10 is a schematic block diagram showing a control system of the multiple infrared temperature sensor of the second embodiment of the invention.

As shown in FIG. 10, the output of the multiple infrared temperature sensor 51 is converted into a digital signal by an A/D converter 52, and then is inputted to a CPU 53 which controls the whole image forming apparatus 1. The CPU 53 includes a first data table 53*a*. The first data table 53*a* has temperature detection results obtained at the initial time by detected the temperature of the heat roller 22 at room temperature (25 to 30° C.) by the first to the fifth detection elements 51*a* to 51*e* of the multiple infrared temperature sensor 51 as a data. Besides, the CPU 53 includes a second data table 53*b* to store temperature detection results outputted from the first to the fifth detection elements 51*a* to 51*e*, which are obtained in such a manner that at the time of warm-up, for example, when the detection temperature of the thermistor 33 is 25° C., the heat roller 22 is actually detected by the multiple infrared temperature sensor 51. Further, the CPU 53 includes a second comparison unit 53*c* to compare the first data table 53*a* and the second data table 53*b*.

Figure 11:
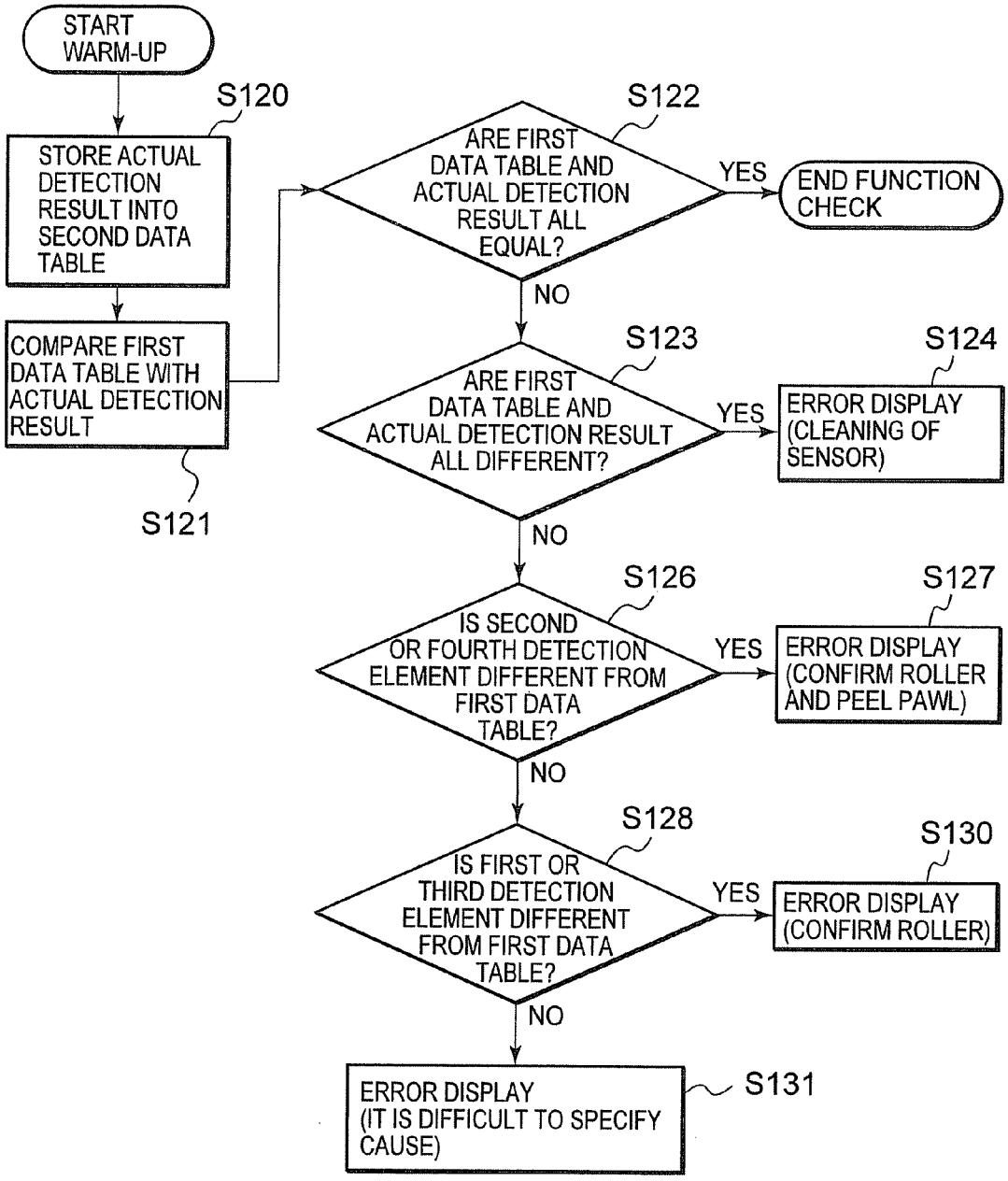
FIG. 11 is a flowchart showing an operation to recognize a state of the multiple infrared temperature sensor of the second embodiment of the invention.

Next, the operation of the multiple infrared temperature sensor 51 will be described with reference to a flowchart shown in FIG. 11. When an image formation process is started, an image forming process is performed in an image formation unit 10, and a toner image is formed on a sheet paper P. In the fixing device 11, the first and the second halogen lamp heaters 27*a* and 27*b* are turned ON, and the warm-up of the heat roller 22 is started. At the time of start of the warm-up and at the time point when the thermistor 33 detects a temperature in the range of 25 to 30° C., the temperature of the heat roller 22 is detected by the multiple infrared temperature sensor 51, and is stored in the second data table 53*b* (step 120) (temperature detected at one point in the range of 25 to 30° C. is stored in the second data table 53*b*) The actual detection result stored in the second data table 53*b* is compared with the first data table 53*a* by the second comparison unit 53*c* (step 121).

From the second comparison result by the second comparison unit 53*c*, when both are the same (Yes at step 122), the CPU 51 recognizes that the multiple infrared temperature sensor 51 functions with high precision, and finishes the function check of the multiple infrared temperature sensor 51.

In the case of No at step 122, the process proceeds to step 123. In the case where all of the first to the fifth detection elements 51*a* to 51*e* are different from the first data table 53*a* (Yes at step 123), the CPU 53 recognizes that the lens of the multiple infrared temperature sensor 51 is contaminated or the heat roller 22 is contaminated. However, the possibility that the lens is contaminated is higher. Accordingly, the CPU 53 displays on the display panel 2 an error message to first urge execution of cleaning of the multiple infrared temperature sensor (step 124). By this, the service man cleans the multiple infrared temperature sensor 51. After the cleaning is finished, it is confirmed whether the multiple infrared temperature sensor 51 normally detects.

In the case of No at step 123, when one of the second and the fourth detection elements 51*b* and 51*d* is different from the first data table (Yes at step 126), the CPU 53 recognizes that there is a high possibility that the heat roller 22 or the press roller 23 is scratched by the peel pawl 31 or 35, or the peel pawl 31 or 35 is contaminated. The CPU 53 displays on the display panel 2 an error message to urge confirmation of the heat roller 22, the press roller 23 and the peel pawls 31 and 35 (step 127). The service man performs maintenance necessary for the heat roller 22, the press roller 23, and the peel pawls 31 and 35, and after the maintenance is finished, it is confirmed whether the multiple infrared temperature sensor 51 normally detects.

In the case of No at step 126, when one of the first and the third detection elements 51*a* and 51*c* is different from the first data table (Yes at step 128), the CPU 53 recognizes that there is a high possibility that the heat roller 22 or the press roller 23 is contaminated. The CPU 53 displays on the display panel 2 an error message to urge confirmation of the heat roller 22 and the press roller 23 (step 130). The service man performs the cleaning or exchange of the heat controller 22 and the press roller 23, and after the cleaning or exchange is finished, it is confirmed whether the multiple infrared temperature sensor 51 normally detects.

In the case of No at step 128, the CPU 53 displays on the display panel 2 an error message that it is difficult to specify the cause (step 131). The service man performs necessary maintenance.

At the time of warm-up, the detection precision of the multiple infrared temperature sensor 51 is ensured through the process. Thereafter, the heat roller 22 is detected the temperature by the high precision multiple infrared temperature sensor 51, the first and the second halogen lamp heaters 27*a* and 27*b* are respectively ON/OFF controlled, and the fixing operation is performed.

Also in this embodiment, similarly to the first embodiment, in the case where an error occurs in the detection result of the multiple infrared temperature sensor 51, it is also possible to correct a temperature conversion table to convert the input signal from the A/D converter 52 of the multiple infrared temperature sensor 51 into temperature data. For example, even if the multiple infrared temperature sensor 51 or the heat roller 22 is not contaminated, there is a case where the surface of the heat roller 22 is changed. Such a state can be found depending on whether the detection result of the fifth detection element 51*e* to detect the position [E] outside the fixing area is normal. In this case, with respect to a detection element in which the temperature detection result is different from the value of the first data table 53*a*, the CPU 53 corrects the temperature conversion table. As a result, even if the surface of the heat roller 22 is changed, the temperature of the heat roller 22 can be controlled with high precision without causing failure of the image forming apparatus 1.

According to this embodiment, similarly to the first embodiment, the temperatures of the plural positions on the heat roller 22 can be detected at the same time without mechanically moving the multiple infrared temperature sensor 51. By this, the first and the second halogen lamp heaters 27*a* and 27*b* can be controlled only by providing the one multiple infrared temperature sensor 51. Besides, the required maintenance is error-displayed from the result of the comparison between the actual detection result by the first to the fifth detection elements 51*a* to 51*e* of the multiple infrared temperature sensor 51 and the data of the first data table 53*a* as the detection result at the initial time. By this, after the maintenance is quickly performed, the heat roller 22 can be controlled the temperature with high precision by using the high precision multiple infrared temperature sensor 51, and excellent fixing performance can be obtained.

Next, a third embodiment of the invention will be described. The third embodiment is such that in the first embodiment, the temperature of the heat roller is detected, and the others are the same as the first embodiment. Accordingly, in the third embodiment, the same structures as the structures described in the first embodiment are denoted by the same symbols and their detailed description will be omitted.

Figure 12:
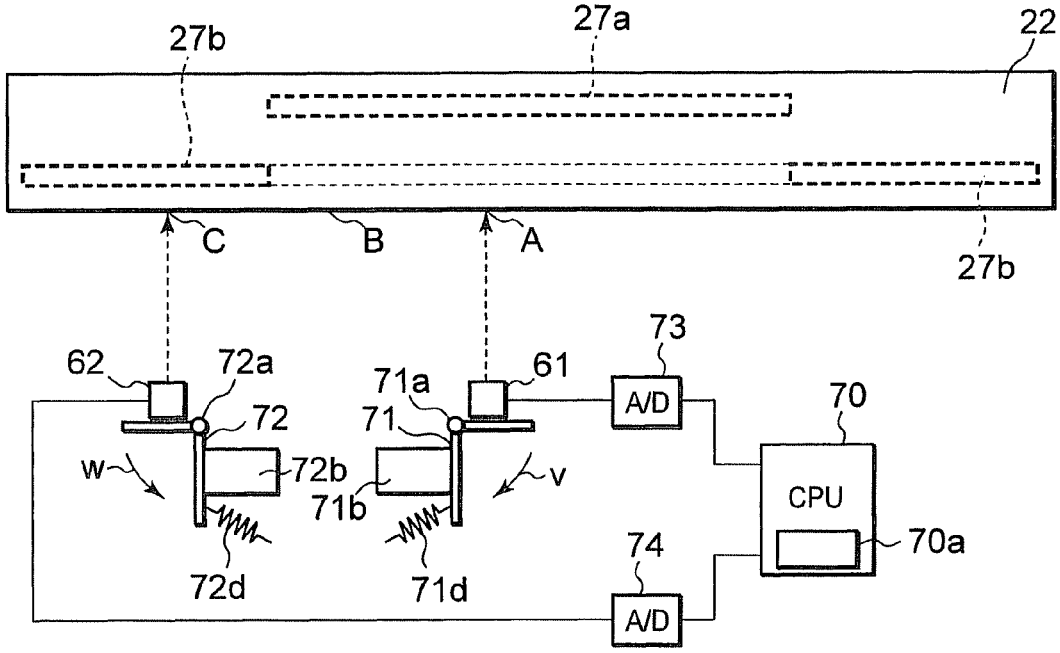
FIG. 12 is a schematic explanatory view showing temperature detection positions on a heat roller by monocular infrared temperature sensors at the time of a fixing mode of a third embodiment of the invention.

In the third embodiment, instead of the multiple infrared temperature sensor 32 of the first embodiment, as shown in FIG. 12, a first monocular infrared temperature sensor 61 of a thermopile type as a non-contact temperature sensor member detects a temperature of a center [A] of an [α] area of a heat roller 22, and a second monocular infrared temperature sensor 62 of a thermopile type as a non-contact temperature sensor member detects a temperature of a center [C] of a [β1] area of the heat roller 22.

Figure 13:
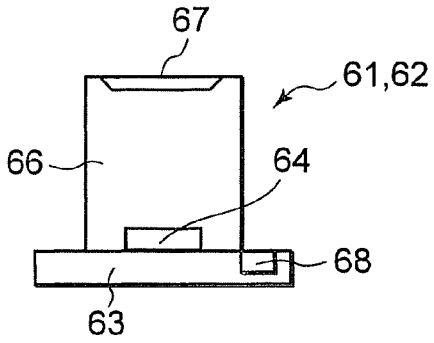
FIG. 13 is a schematic structural view of the monocular infrared temperature sensor of the third embodiment of the invention.

For example, as shown in FIG. 13, each of the first and the second monocular infrared temperature sensors 61 and 62 is constructed such that a thermopile element 64 is attached onto a board 63 and is covered with a case 66. The case 66 has a light receiving window 67 made of a silicon lens or the like, and condenses infrared rays from the heat roller 22 to the thermopile element 64. Further, the board 63 includes a thermistor 68 to detect the temperature of the monocular infrared temperature sensor 61 or 62 itself. With respect to the monocular infrared temperature sensors 61 and 62, based on output signals of the thermopile elements 64 obtained by receiving the infrared rays and peripheral temperatures of the monocular infrared temperature sensors 61 and 62 themselves detected by using the thermistors 68, the temperature of the heat roller 22 is calculated by a CPU 70 which controls the whole image forming apparatus 1.

The heat roller 22 is detected a temperature by the first and the second monocular infrared temperature sensors 61 and 62, and a first and a second halogen lamp heater 27*a* and 27*b* are respectively ON/OFF controlled. By this, the temperature distribution of the heat roller 22 in the longitudinal direction is made uniform.

Figure 14:
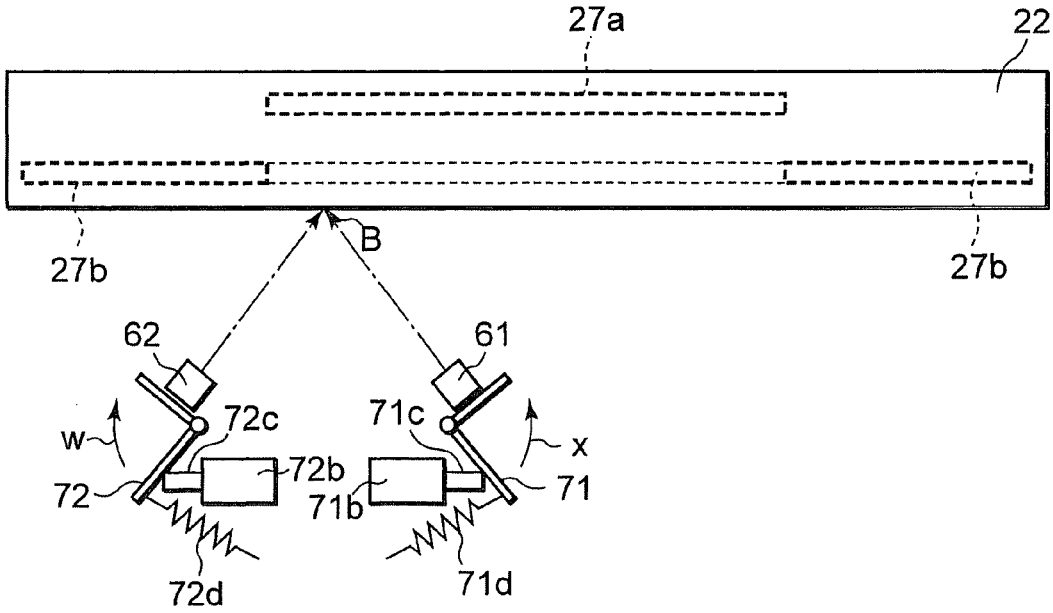
FIG. 14 is a schematic explanatory view showing temperature detection positions on the heat roller by the monocular infrared temperature sensors at the time of a same position detection mode of the third embodiment of the invention.

The first and the second monocular infrared temperature sensors 61 and 62 are respectively attached to a first and a second support member 71 and 72 made of plastic as movable members. The first and the second support members 71 and 72 are respectively rotatable around supporting points 71*a* and 72*a*. The first and the second support members 71 and 72 are always urged toward an arrow v direction and an arrow w direction by springs 71*d* and 72*d* while solenoids 71*b* and 72*b* are used as stoppers as shown in FIG. 12. As shown in FIG. 14, when movements 71*c* and 72*c* of the solenoids 71*b* and 72*b* are protruded, the support members 71 and 72 are rotated in an arrow x direction and an arrow y direction against the springs 71*d* and 72*d*.

By the rotation of the support members 71 and 72 in the arrow x direction and the arrow y direction, the first and the second monocular infrared temperature sensors 61 and 62 irradiate infrared rays toward a direction of an intermediate position [B] between the position [A] and the position [C] of the heat roller 22, and the position [B] is detected the temperature at the same time. For example, in the case where the first and the second monocular infrared temperature sensors 61 and 62 normally operate, there is no surface change of the heat roller 22 and no aging of the first or the second monocular infrared temperature sensor 61 or 62, and there is no deposition on the light receiving window 67 or the heat roller 22, the temperature detection values of the position [B] by the first and the second monocular infrared temperature sensors 61 and 62 becomes equal to each other.

The outputs of the first and the second monocular infrared temperature sensors 61 and 62 are converted into digital signals by a first and a second A/D converter 73 and 74, and then are inputted to the CPU 70. The CPU 70 includes a third comparison unit 70*a* to compare the input signal from the first A/D converter 73 and the input signal from the second A/D converter 74 and to output a third comparison result.

The third comparison unit 70*a* compares the outputs of the first and the second A/D converters 73 and 74 at the time of a same position detection mode in which the first and the second monocular infrared temperature sensors 61 and 62 detect the temperature of the position [B] at the same time.

Next, the operation will be described. When an image formation process is started, in an image formation unit 10, an image forming process is performed, and a toner image is formed on a sheet paper P. In the fixing device 11 which is normally placed in a fixing mode, the first and/or the second halogen lamp heater 27*a* and/or 27*b* is turned ON, and warm-up of the heat roller 22 is started. At the time of the image formation process, the first or the second monocular infrared temperature sensor 61 or 62 is supported at the position shown in FIG. 12 by the first or the second support member 71 or 72.

The first monocular infrared temperature sensor 61 detects the temperature of the position [A] of the heat roller 22, and the second monocular infrared temperature sensor 62 detects the temperature of the position [C] of the heat roller 22. After the warm-up is finished, the first and the second halogen lamp heaters 27*a* and 27*b* are ON/OFF controlled in accordance with the temperature detection result of the first or the second monocular infrared temperature sensor 61 or 62, and the fixing operation is performed.

While the surface temperature of the heat roller 22 is detected as stated above, there occurs, for example, a surface change of the heat roller 22 or aging of the first or the second monocular infrared temperature sensor 61 or 62. Alternatively, while the surface temperature of the heat roller 22 is detected, for example, dust or dirt, such as scattered toner or paper powder, is attached to the surface of the light receiving window 67 of the first or the second monocular infrared temperature sensor 61 or 62 or the surface of the heat roller 22. The output of the first or the second monocular infrared temperature sensor 61 or 62 is reduced from the cause as stated above. As a result, the detected temperature of the first or the second monocular infrared temperature sensor 61 or 62 becomes different from the actual temperature of the heat roller 22.

Then, according to a specified timing or as the need arises, the fixing device 11 is switched from the fixing mode to the same position detection mode, and the solenoids 71*b* and 72*b* are driven to rotate the first and the second support member 71 or 72 as shown in FIG. 14. By this, the first and the second monocular infrared temperature sensors 61 and 62 temperature detect the position [B] of the heat roller 22 at the same time.

The temperature detection results of the first and the second monocular infrared temperature sensors 61 and 62 are compared by the comparison unit 70*a* of the CPU 70. In the case where the temperature detection results of the first monocular infrared temperature sensor 61 and the second monocular infrared temperature sensor 62 are different from each other, the CPU 70 recognizes that there is a high possibility that the light receiving window 67 is contaminated. By this, the CPU 70 displays on the display panel 2 an error message that cleaning of the first or the second monocular infrared temperature sensor 61 or 62 is necessary. By this, the service man cleans the light receiving window 67. After the cleaning is finished, it is confirmed whether the first and the second monocular infrared temperature sensors 61 and 62 normally detect.

Incidentally, in the case where the error of the detection results of the first and the second monocular infrared temperature sensors 61 and 62 is large from the comparison result of the third comparison unit 70*a*, at the same time as the display of the error message, the image forming apparatus 1 may be stopped to prevent the rise in temperature of the heat roller 22 by the erroneous detection. Further, in the case where there occurs the surface change of the heat roller 22 or the aging of the first and the second monocular infrared temperature sensors 61 and 62, a temperature conversion table to convert the input signals from the A/D converters 73 and 74 into temperature data may be corrected.

After the cleaning is finished, the fixing device 11 is switched to the fixing mode, and the ON/OFF control of the first and the second halogen lamp heaters 27*a* and 27*b* is performed in accordance with the temperature detection results of the first and the second monocular infrared temperature sensors 61 and 62.

According to this embodiment, while the first and the second monocular infrared temperature sensors 61 and 62 are used, and the first or the second halogen lamp heater 27*a* or 27*b* is controlled, the fixing device is switched to the same position detection mode, and the first and the second monocular infrared temperature sensors 61 and 62 detect the temperature of the same position [B]. When the detection results of the first and the second monocular infrared temperature sensors 61 and 62 are different from each other, the error message is displayed. By this, the necessity of cleaning of the first and the second monocular infrared temperature sensors 61 and 62 can be quickly recognized. As a result, the first and the second monocular infrared temperature sensors 61 and 62 can always control the temperature of the heat roller 22 with high precision, and excellent fixing performance can be obtained.

What is claimed is:

1. A fixing device comprising:

a heating target member that includes a heat roller and a press roller, and comes in contact with a fixing target medium and fixes a toner image on the fixing target medium;

a first heater configured to heat a center part of the heat roller;

a second heater configured to heat a side part of the heat roller;

a non-contact temperature sensor member to detect temperatures of a plurality of positions which includes a non-imaged formation area of the heat roller;

a contact temperature sensor member that is positioned on the non-image formation area, comes in contact with a same phase position as a temperature detect position by the non-contact temperature sensor member and detects a temperature of the heat roller; and a first comparison unit that compares a detection result of the non-imaged formation area which is measured by the contact temperature sensor member and a detection result of the non-imaged formation area which is measured by the non-contact temperature sensor member.

2. The fixing device according to claim 1, wherein the non-contact temperature sensor member is a multiple thermopile infrared temperature sensor.

3. The fixing device according to claim 1, further comprising a display member to display an error state according to a comparison result of the first comparison unit.

4. The fixing device according to claim 3, wherein the display member displays necessity of cleaning.

5. The fixing device according to claim 1, further comprising a correction member to correct the detection result of the non-contact temperature sensor member according to a first comparison result of the first comparison unit.

* * * * *